United States Patent [19]

Hill

[11] 3,963,383

[45] June 15, 1976

[54] AIR DRIVEN PUMP

[75] Inventor: David C. Hill, Pasadena, Calif.

[73] Assignee: Haskel Engineering & Supply Co., Burbank, Calif.

[22] Filed: Aug. 13, 1974

[21] Appl. No.: 497,013

Related U.S. Application Data

[60] Continuation of Ser. No. 294,906, Oct. 4, 1972, abandoned, which is a division of Ser. No. 88,234, Nov. 9, 1970, abandoned, which is a continuation of Ser. No. 798,900, Feb. 13, 1969, abandoned, which is a continuation-in-part of Ser. No. 690,185, Dec. 13, 1967, Pat. No. 3,489,100.

[52] U.S. Cl. ..... 417/401; 91/306; 91/307; 91/309; 91/313

[51] Int. Cl.[2] ..... F01L 25/06

[58] Field of Search ..... 91/306, 304, 305, 319, 91/309, 307, 313, 341; 417/401

[56] References Cited

UNITED STATES PATENTS

| | | | |
|---|---|---|---|
| 159,782 | 2/1875 | Westinghouse, Jr. | 91/309 |
| 785,889 | 3/1905 | Jones | 91/309 |
| 1,962,986 | 6/1934 | Dole | 91/305 |
| 3,035,548 | 5/1962 | Wittlich | 91/319 |
| 3,489,100 | 1/1970 | Hill | 91/307 |

FOREIGN PATENTS OR APPLICATIONS

| | | | |
|---|---|---|---|
| 881,278 | 6/1953 | Germany | 91/319 |

*Primary Examiner*—Paul E. Maslousky
*Attorney, Agent, or Firm*—Fulwider Patton Rieber Lee & Utecht

[57] ABSTRACT

The device is an air driven piston in a cylinder driving a pump. A shuttle valve is provided to control the admission of air under pressure to, and exhaust from the cylinder. The shuttle valve is a double ended piston operating in coaxial bores with a stem part of smaller diameter between the ends. The air passes to the cylinder tnrough the bore around the intermediate part of the double ended shuttle valve. The piston at one end of the shuttle valve has greater area exposed to pressure than the area of the piston on the other end of the valve. The shuttle valve is operated by one or more pilot valves that are actuated by the main piston. The shuttle valve is shifted by controlling the pressures acting on the parts of the pistons having exposed areas of different sizes.

5 Claims, 4 Drawing Figures

AIR DRIVEN PUMP

This application is a continuation of Ser. No. 294,906, filed on Oct. 4, 1972, now abandoned, which was a division of application Ser. No. 88,234, filed Nov. 9, 1970, now abandoned, which was a continuation of Ser. No. 798,900, filed Feb. 13, 1969, now abandoned, which was a continuation-in-part of application Ser. No. 690,185, filed Dec. 13, 1967, now U.S. Pat. No. 3,489,100 issued Jan. 13, 1970.

SUMMARY OF THE INVENTION

The invention relates to air driven pumps and in the exemplary embodiments of the invention shown herein, it comprises an air operated piston moving in a cylinder. In the exemplary forms of the invention described herein, the air driven piston operates a pump although other types of mechanisms could be driven by the air operated piston.

The air driven piston, of course, reciprocates in the cylinder. The improvements of the invention reside particularly in the valve means for controlling the pressure in the air cylinder whereby to cause the piston to reciprocate. In the preferred embodiments of the invention disclosed herein, the air in the cylinder is controlled by a shuttle valve or control valve which in turn is controlled by one or more pilot valves. The herein invention embodies improvements in air driven pistons of the type shown in prior U.S. Pat. No. 3,174,409. In the preferred embodiment of the invention the piston is driven in one direction by a spring. The control or shuttle valve is a double ended piston valve having a stem of smaller diameter extending between the two pistons which move in bores of different diameters. The area of one piston is different than the area of the other and advantageous use is made of this differential for operating the shuttle valve. Air from the source of supply that drives the main piston passes to the main cylinder around the intermediate stem part of the shuttle valve. Pressure from the supply thus acts on the inner side of each piston. The pressure acting on the other side of the larger piston member is controlled by one or more pilot valves whereby to cause shifting of the shuttle valve to admit air under pressure to the main piston and for releasing the air therefrom causing it to reciprocate in a cylinder as will be described in detail hereinafter.

In one embodiment of the invention two separate pilot valves are utilized which have stems operated by the main piston in the air cylinder for controlling the pressure in the control chamber of the shuttle valve for shifting it, to bring about reciprocation of the piston in the air cylinder. In a modified and preferred form of the invention one pilot valve is constructed to be a part of a stem moved by the main piston. In a further modified form of the invention only one pilot valve is used which is of the type having a stem actuated by the main piston, bleed orifices being provided to assist in controlling pressure in the control chamber of the shuttle valve in a manner to obviate the need for two pilot valves.

A primary object of the invention is to provide an air cylinder for driving a pump as shown in the preferred embodiments having improved, simplified, and more effective valve control means for controlling the pressure in the cylinder to cause the piston to reciprocate.

A further object is to provide improvements as set forth in the foregoing object comprising a double ended piston type shuttle valve having simplified control means for causing shifting of the shuttle valve to control pressure in the main cylinder and reciprocation of the piston therein.

A further object is to provide improvements as set forth in the foregoing objects, characterized in that simplified valve and conduit arrangements are provided for bringing about shifting of the shuttle valve. A particular object resides in the realization of minimization of the number of, and complexity of control channels provided for purposes of causing shifting of the shuttle valve.

Further objects of the invention will become apparent from the following detailed description and annexed drawings wherein.

Figure 1:
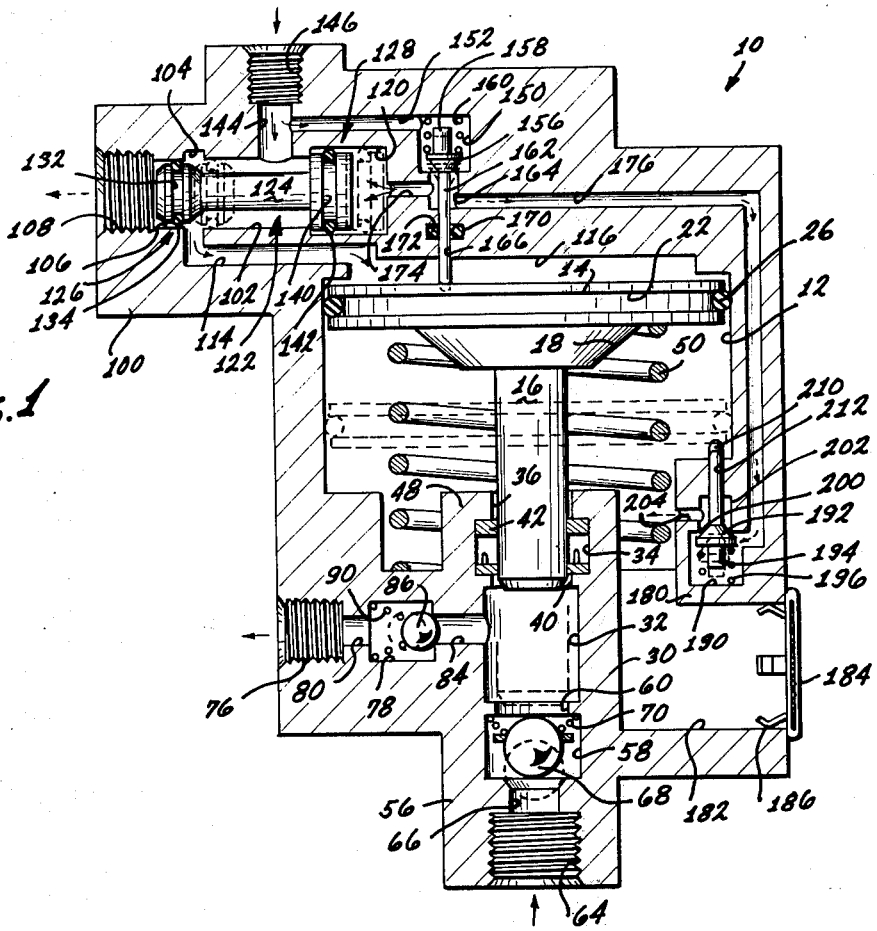
FIG. 1 is a cross-sectional view of one form of the invention.

Referring now more in detail to FIG. 1 of the drawings this figure is a partially diagrammatic cross-sectional view of a preferred form of air driven pump. The body is cylindrical, having upper and lower heads. In the body is a cylindrical bore 12 and movable in this bore is a piston 14 and stem 16. The piston 14 has an annular groove 22 in which is carried a sealing O-ring 26. In the form of the invention shown, the stem 16 constitutes the plunger of a pump of the type shown in U.S. Pat. No. 3,174,409. Within body 10 at the lower part thereof there is provided an integral structure 30 forming the pump, this structure having a bore 32 that is coaxial with the plunger 16. The part 30 has a bore 34 of a larger diameter above the bore 32 and it has another bore 36 in the end part of the structure through which the plunger 16 extends. There is also a bore 40 of smaller diameter between the bores 32 and 34. Within the bore 34 there is provided a seal 42 which may be of an appropriate type to seal the plunger 16. The structural part 30 is generally cylindrical at the upper part which is designated by the numeral 48 and this part forms a spring retainer for coil return spring 50, the upper end of which seats around the tapered part 18 underneath the piston 14. The other end of the spring 50 seats around the upper part of 48 of the structure 30 which is integral with a side part of the valve body 10 as shown.

Extending from the lower side of the valve body 10 is a cylindrical boss 56 which is an extension of the structural part 30. In this part is a bore 58 and between this bore and the bore 30 is a bore 60 of smaller diameter, these bores being coaxial. In the boss 56 is a threaded bore 64 adapted to receive a coupling or nipple and between this bore and the bore 58 is a bore 66 of smaller diameter, the inner end of which is tapered to form a valve seat for a ball valve 68 which may be provided with spring biasing means tending to seat it, such a spring being shown at 70, the spring being seated in the end of the bore 58 and bearing against abutments on the valve 68. The valve 68 is the inlet valve of the pump formed by the parts that have just been described.

A pump outlet valve is provided in the lower part of the left side of the body 10. Numeral 76 designates a threaded bore in the side of the body 10 adapted to receive a coupling or nipple and it communicates with a transverse bore 78 by way of a smaller bore 80. The bore 78 communicates with the bore 43 by way of a transverse bore 84 the left end of which is biased in closing direction by a conical biasing spring 90 one end of which seats against an end of the bore 78 and the other end of which engages the valve 86. The valve just described constitutes an outlet valve for the pump formed by the plunger 16 and cylindrical bore or chamber 32. It will be observed that the plunger 16 is of smaller diameter than the bore 32 so that it does not bear against the sidewalls of the bore 32 for purposes as set forth in detail in U.S. Pat. No. 3,174,409.

As pointed out in the foregoing, the particular improvements of the invention reside in the control valve or shuttle valve and the arrangements for shifting this valve. The upper part of the body 10 is enlarged at the left forming an embossment as designated at 100. Numeral 102 designates a transverse bore. In this part of the valve at one end of this bore is a short but larger coaxial bore 104 which communicates with another bore 106 which in turn connects to a larger threaded bore 108 adapted for receiving a coupling or nipple. The bore 104 communicates by way of a channel 114 with a bore 116 which is a bore of slightly smaller diameter at the end of bore 12 above the piston 14.

At the other end of the bore 102 is a larger bore 120. The shuttle valve or control itself is designated generally by the numeral 122. It comprises a stem 124 of smaller diameter than the bore 102 having a piston at each end, the piston at end being designated by the numeral 126 and the piston at the other end being designated by the numeral 128. The piston 126 is cylindrical having an intermediate annular groove 132 in which is a sealing O-ring 134. As will be seen the piston valve 126 has tapering or bevelled surfaces on each side adjacent to the cylindrical part in which is the annular groove 132. The piston 126 reciprocates adjacent to the bore 104 so that it can either open the channel 114 to communication with the bore 102 or it can open this channel to communication with the bore 106. The two positions of the piston 126 are shown in full and broken lines. As may be seen piston 128 is larger than piston 126. As may be seen, a chamber is formed in bore 102 around stem 124 and the interior of bore 120 is a control chamber.

The piston 128 has an intermediate annular groove 140 in which is a sealing O-ring 142. The two positions of the piston 128 are shown in full and broken lines.

Numeral 144 designates a bore which is transverse to the bore 102 and which communicates with a threaded bore 146 adapted for receiving a coupling or nipple.

Numeral 150 designates a cylindrical pilot valve bore in the upper part of the body 10 which communicates with the bore 144 by way of a transverse bore or channel 152. In the bore 150 is a tapered pilot valve 156 having an upper extending part 158. Surrounding the part 158 is a biasing spring 160 which seats against the end of the bore 150 and normally urges the pilot valve 158 in closing direction. The valve 156 has a stem 162 that extends downwardly through a bore 164 and a smaller bore 166, so that it extends into the bore 116 into a position wherein it can be physically actuated by the piston 14. Numeral 170 designates an annular groove around the bore 166 in which is a sealing O-ring 172. The bore 164 communicates with the bore 120 by way of a transverse bore or channel 174. Numeral 176 designates a further channel connecting to bore 164 and to another pilot valve as will be described.

Numeral 180 designates a boss or enlargement on the inside of the body 10 spaced from the structure 30 and in which is provided a second pilot valve. The bore 12 in the body 10 communicates with transverse channel 182 in body 10 which normally may have its end part closed by way of a closure disc 184 held in position by spring clips 186. In the part 180 is a bore 190 in which is a tapered pilot valve 192 having an extending part 194. Surrounding this part is a biasing spring 196, one end of which seats against the end of the bore 190 and the other end of which acts against the valve 192, normally biasing it into closing direction. Valve 192 seats against a seat 200 communicating with a bore 202 in the part 180 which communicates with the bore 12 and the channel 182. The pilot valve 192 has a stem 210 extending through a bore 212 into a position within bore 12 where it can be physically actuated by the piston 14.

As will be described the piston 14 is, of course, reciprocated in the bore 12 to actuate the pump plunger 16, the piston being moved upwardly by spring 50. The plunger 16 acts as a pump to draw fluid into the bore 32 through the valve 68 discharging it through the valve 86 in a manner well known in the art.

The threaded bore 146 is connected to a source of air under pressure which is the motive power for the piston 14. The position of the piston 14 and of the control valve 122 as shown in full lines is the position at the beginning of the downstroke and the position of these parts in broken lines is that at the end of the pumping stroke.

With the parts in full line position air entering through the bore 146 passes through channel 144, bore 102 around the stem 124, through the channel 114 into the bores 116 and 12. The pressure forces the piston 14 down to the dotted line position thereby performing the pumping stroke. At the beginning of the pumping stroke with the parts in the full line position, the pilot valve 156 is open as shown, having been opened by the piston 14 engaging the stem 163. In this position pressure from within bore 146 passes through channel 152 through the pilot valve 156 into bore 164 and through channel 174 into the control chamber within bore 120 to the right of piston 128. This pressure holds the shuttle valve 122 in the leftward position, that is, the full line position. Since pilot valve 192 is closed at this time pressure cannot be released from the channel 176. The shuttle valve 122 is held in its leftward position because the exposed area of the piston 128 in bore 120 is greater than its exposed area on its left side, that is exposed to pressure in bore 102.

As the piston 14 moves down it engages the stem 210 of pilot valve 192 and opens this valve which opens the end of channel 176 releasing pressure therefrom and from the control chamber within bore 120 to the right of piston 128. The pressure within bore 102 is now sufficient acting on the left end of piston 128 to shift the shuttle or control valve into its right hand or dotted line position. In this position the piston 126 moves to the other side of the end of channel 114 so that pressure from the source can no longer enter this channel, but on the other hand the pressure that is within the bores 116 and 12 is now released through the bores 106 and 108 to atmosphere. Release of pressure on the piston 14 permits it to be driven upwardly by the spring 50 thereby moving the plunger 16 similarly. Upon movement of piston 14 up to a position where it again engages stem 126 the operating cycle is repeated. Thus, it may be seen in this manner, the piston 14 acts as a motor reciprocating to operate the pump formed by the plunger 16 and bore 32.

Figure 2:
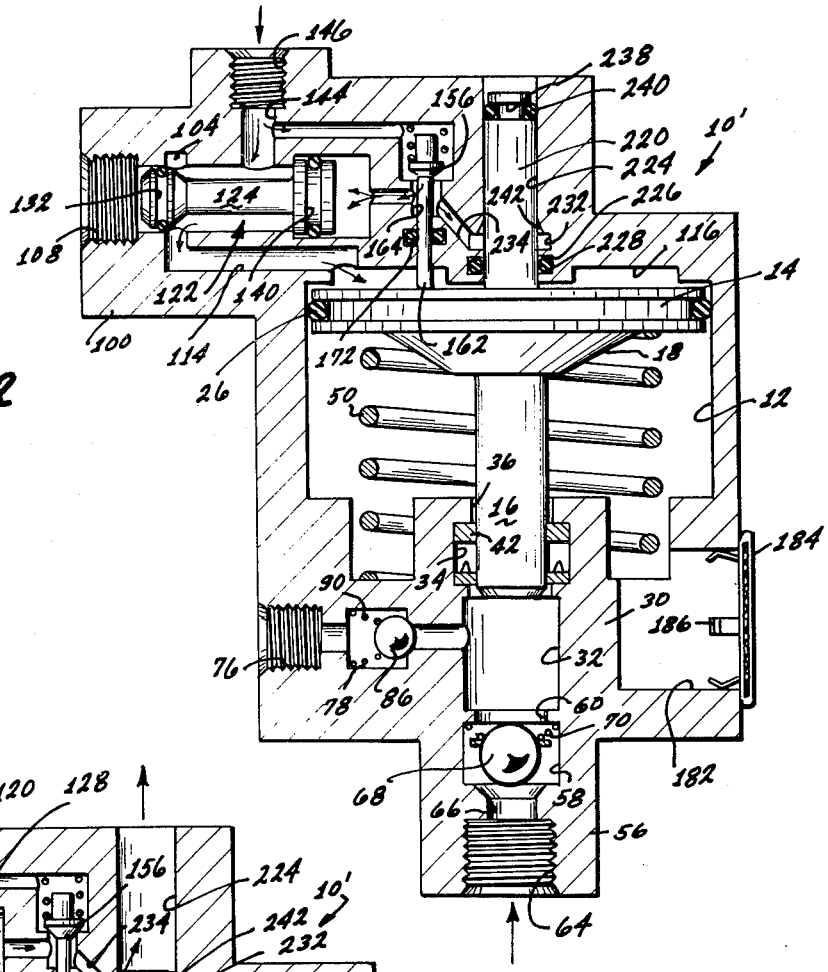
FIG. 2 is a cross-sectional view of a preferred form of the invention.

FIG. 2 shows a preferred form of the invention. Parts in FIG. 2 that are like corresponding parts in FIG. 1 are identified by the same reference characters so that the detailed description of these parts need not be repeated. In this form of the invention the pilot valve 192 is eliminated as well as the channels leading to it. A second pilot valve is provided by a stem extending from the piston 14. This stem is designated by the numeral 220. It moves in a cylindrical bore 224 in the body 10'. In a sidewall of this bore is an annular groove 226 in which is a sealing O-ring 228. Above the sealing O-ring is an annular groove 232 and communicating with the groove is the channel 234 which communicates with the bore 164. At the upper end of the stem 220 there is an annular groove 238 in which is a sealing O-ring 240.

Between the bores 224 and 232 is a tapered bore 242. FIG. 2 shows the position of the device when the piston 14 is at the upper limit of the stroke and at this position it has engaged the stem 162 opening the pilot valve 156 and causing the shuttle valve 122 to be moved to its left hand position as described in connection with the previous embodiment. In this position of the parts pressure cannot escape from the channel 234 since the stem 220 is sealed in the bore 224 by the O-rings 228 and 240. The operation is now the same as that of the previous embodiment, in that the pressure in the bores 12 and 116 causes the piston 14 to move to its lower most position operating the pump as already described.

Figure 3:
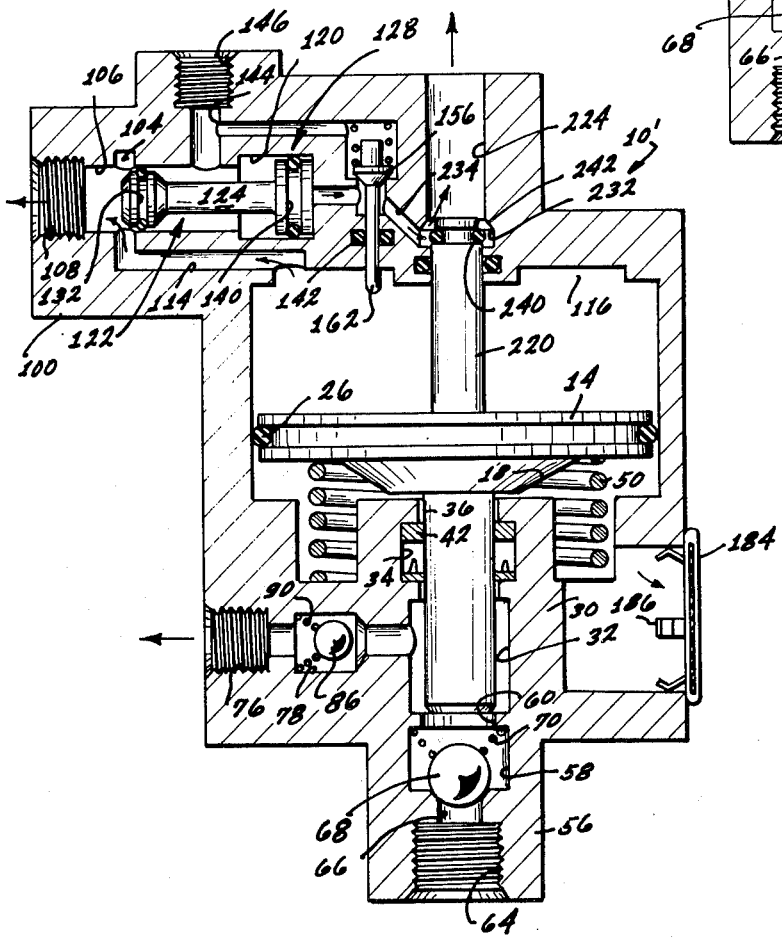
FIG. 3 is a cross-sectional view of the form of the invention shown in FIG. 2 with the parts in another position.

FIG. 3 shows the position of the parts when the piston 14 is at its lower most position. In this position the stem 220 has moved down into a position wherein the O-ring 240 is in the annular groove 232 so that communication is provided between the channel 234, the annular groove 232, the bore 242 and the bore 224 so that pressure is now released from the control chamber within bore 120 to the right of piston 128, valve 156 now being closed. Thus, the shuttle valve 122 moves to its right hand position as shown in FIG. 3 wherein the end of channel 114 is opened to communicate with bores 106 and 108. This releases the pressure from the piston 14 allowing it to be moved up by the spring 50 and when it again re-engages the stem 162 the cycle will be repeated as described in the foregoing.

Figure 4:
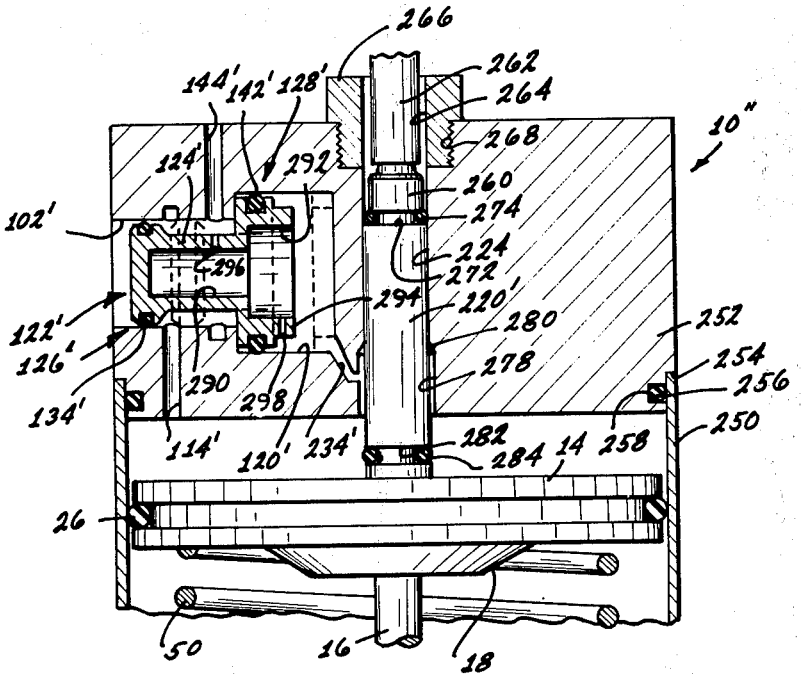
FIG. 4 is a cross-sectional view of a further modified form of the invention.

FIG. 4 shows another modified form of the invention which uses only a single pilot valve which is of the type operated by the stem of the main valve as in FIGS. 2 and 3. The use of a single pilot valve in this form of the invention is made possible by utilizing bleed orifices in the shuttle valve 122' as will be described. Parts that are the same as in previous embodiments are identified by the same reference characters and parts that correspond to parts of the previous embodiment but that are modified are identified by similar characters primed.

In FIG. 4 the body is identified by numeral 10''. It has a cylindrical body 250 which is attached to the head part 252 by being secured in an annular shoulder 254 in the head and sealed by an O-ring 256 in an annular groove 258. The stem 220' has an upper part 260 of smaller diameter than the bore 224 and a further end part 262 of smaller diameter that extends through a bore 264 in an end plug 266 that is threaded into a bore 268 in the head 252. The stem 220' has an annular groove 272 in which is a sealing O-ring 274. The lower part of the bore 224 is enlarged as shown at 278 having a tapered upper part 280 where it joins the bore 224. The channel 234' extends between the bore 278 and bore 120' as in the previous embodiment. The stem 220' has an annular groove 282 in which is a sealing O-ring 284 which can seal within the bore 278.

The shuttle valve 122' is slightly modified with respect to the shuttle valve 122 of the previous embodiments. It is double ended having a piston 126' at one end and a larger piston 128' at the opposite end. The piston 126' moves in the bore 102' and the piston 128' moves in the bore 120'. The shuttle valve 122' itself has a bore 290 and an end counterbore 292, the control chamber within bore 120' beng in communication with these bores, the piston 128' having an extending ring part 294 of smaller diameter that can about the end of the bore 120' when the shuttle valve 122' is in the dotted line position as illustrated in FIG. 4. Communicating with the bore 290 is a bleed port or channel 296 and extending transversely through the extending part 294 is another bleed port 298 which can provide communication between the interior of shuttle valve 122' and the control chamber within bore 120' when the shuttle valve 122' is in the right hand position against the end of bore 120'.

The following will describe the operation of the piston and cylinder of FIG. 4. The shuttle valve is shown in the full line position with the piston 14 below its upper most position. The shuttle valve is in the left hand position wherein pressure entering through channel 144' can pass around the barrel or stem part 124'of shuttle valve 122' and can pass through channel 114' into the bore or cylinder space above the piston 14. The shuttle valve is in the pump stroke position. The stem 220° is in position wherein the O-ring 274 seals the bore 224 preventing escape of pressure from within the control chamber within bore 120' keeping the shuttle 122' in its left hand position. The pressure above the piston 14 forces it down making the pumping stroke. At the lower most position of the stroke the O-ring 274 on stem 220 prasses down into bore 278 and below the end of channel 234'. This releases the pressure in the control chamber in bore 120' to atmopshere around the stem part 260 and through the bore 264. Upon this release of pressure from within the control chamber in bore 120' the pressure within bore 102' around the barrel 124' of the shuttle valve 122' is sufficient to move the shuttle valve to the right hand position as shown in broken lines wherein the extending rim 264 is against the end of bore 120'. In the right hand position of the shuttle valve 120' the channel 114' is in communication with the bore 108' releasing pressure from within the valve body 250 above the piston 14 allowing it to be forced upwardly by the spring 50. It moves upwardly until the O-ring 284 is moved into a position in bore 278 below the end of the channel 234'. Air from the channel 144' now bleeds through the orifice 296 into the interior of shuttle valve 122' and it bleeds through the orifice 298 into the control chamber 120' opposite the end of the piston 128'. The pressure in the control chamber acting on the piston 128' is now sufficient to move the shuttle valve to the left to its full line position again allowing air from the channel 144' to enter into the cylinder chamber above the piston 14 causing the piston again to move downwardly, the cycle being repeated as described.

From the foregoing, those skilled in the art will readily understand and appreciate the nature and construction of the invention and the manner in which it achieves and realizes all of the objects and advantages as set forth in the foregoing as well as the many additional advantages that are apparent from the detailed description.

The foregoing disclosure is representative of preferred forms of the invention and is to be interpreted in an illustrative rather than a limiting sense, the invention to be accorded the full scope of the claims appended hereto.

What is claimed is:

1. A fluid driven pump which includes:

a pump housing having a pump chamber therein;

a pump piston reciprocable in said pump chamber;

fluid inlet and outlet means having valving means and connected to said pump chamber for intake and output of fluid from said pump chamber;

driving piston means for reciprocating said pump piston;

driving chamber means enclosing said driving piston means;

driving fluid inlet and outlet means;

shuttle valve means movable between a first position connecting said driving fluid inlet to said driving chamber means, and a second position connecting said driving fluid outlet to said driving chamber means;

valve piston means connected to said shuttle valve means for operating the same, said valve piston means having a first surface whose effective area for moving said shuttle valve means toward said first position is larger than that of a second surface for moving said valve piston means toward said second position;

passageway means for conducting driving fluid under pressure from said fluid inlet to said first surface;

other passageway means for conducting driving fluid under pressure from said fluid inlet to said second surface;

other valve means operated by said driving piston to release pressure applied to said first surface, whereby opening of said other valve means causes movement of said valve piston means and said shuttle valve means to said second position; and additional valve means operated by said driving piston to supply pressure to said first surface, whereby operation of said additional valve means causes movement of said valve piston means and said shuttle valve means to said first position, said other valve and said additional valve being operated to open at different times in accordance with the movement of said driving piston.

2. A pump as defined in claim 1, in which said other valve means includes a stem connected to said driving piston and movable therewith, said stem sliding in a further passageway and making a sealing fit therewith, and an additional passageway extends from adjacent said first surface to said further passageway, said stem uncovering said additional passageway for connection to said further passageway at a first limiting position of said driving piston.

3. A fluid driven pump which includes:

a pump housing having a pump chamber therein;

a pump piston reciprocable in said pump chamber;

fluid inlet and outlet means having valving means and connected to said pump chamber for intake and output of fluid from said pump chamber;

driving piston means for reciprocating said pump system;

driving chamber means enclosing said driving piston means;

driving fluid inlet and outlet means;

shuttle valve means movable between a first position connecting said driving fluid inlet to said driving chamber means, and a second position connecting said driving fluid outlet to said driving chamber means;

valve piston means connected to said shuttle valve means for operating the same, said valve piston means having a first surface whose effective area for moving said shuttle valve means toward said first position is larger than that of a second surface for moving said valve piston means toward said second position;

first passageway means for conducting driving fluid under pressure from said fluid inlet to said first surface;

other passageway means for conducting driving fluid under pressure from said fluid inlet to said second surface;

other valve means operated by said driving piston to release pressure applied to said first surface, whereby opening of said other valve means causes movement of said valve piston means and said shuttle valve means to said second position, said other valve means including a stem connected to said driving piston and movable therewith, said stem sliding in a further passageway and making a sealing fit therewith;

additional passageway means extending from adjacent said first surface to said further passageway, said stem uncovering said additional passageway for connection to said further passageway at a first limiting position of said driving piston; and additional valve means operated by said driving piston to supply pressure to said first surface, whereby operation of said additional valve means causes movement of said valve piston means and said shuttle valve means to said first position, said other valve and said additional valve being operated to open at different times in accordance with the movement of said driving piston.

4. A pump as defined in claim 3 in which said additional valve is located in said front passageway means, said additional valve normally being closed, but having means opening it when said driving piston is in a second limiting position, whereby fluid under pressure is admitted to drive said valve piston means toward said first position at the beginning of a stroke of said driving piston, and said fluid under pressure is released to permit the movement of said valve piston means to said second position at the end of a stroke of said driving piston.

5. A pump as defined in claim 3, in which said first passageway means is a bleed passageway in said valve piston that conducts fluid from said driving fluid inlet to said first surface.

* * * * *

UNITED STATES PATENT AND TRADEMARK OFFICE

CERTIFICATE OF CORRECTION

PATENT NO. : 3,963,383
DATED : June 15, 1976
INVENTOR(S) : DAVID C. HILL

It is certified that error appears in the above-identified patent and that said Letters Patent are hereby corrected as shown below:

Col. 3, line 6, before "biased" insert -- is tapered to form a seat for ball valve 86 which is --

Col. 3, line 32, before "end" (second occurrence) insert -- one --

Col. 6, line 43, "prasses" should be -- passes --

Col. 6, line 53 "120'" should be -- 122' --

Signed and Sealed this

Sixteenth Day of November 1976

[SEAL]

*Attest:*

RUTH C. MASON
*Attesting Officer*

C. MARSHALL DANN
*Commissioner of Patents and Trademarks*